US010883757B2

(12) United States Patent
Sanders et al.

(10) Patent No.: US 10,883,757 B2
(45) **Date of Patent: *Jan. 5, 2021**

(54) SYSTEM AND METHOD OF CONTROLLING REFRIGERATOR AND FREEZER UNITS TO REDUCE CONSUMED ENERGY

(71) Applicant: ILLINOIS TOOL WORKS INC., Glenview, IL (US)

(72) Inventors: Joseph F. Sanders, North Richland Hills, TX (US); Charles M. Louis, Fort Worth, TX (US); Steven T. Jackson, Fort Worth, TX (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/402,337

(22) Filed: May 3, 2019

(65) Prior Publication Data

US 2019/0257567 A1 Aug. 22, 2019

Related U.S. Application Data

(63) Continuation of application No. 14/809,492, filed on Jul. 27, 2015, now Pat. No. 10,323,875.

(51) Int. Cl.
*F25B 47/00* (2006.01)
*F25D 21/04* (2006.01)
(Continued)

(52) U.S. Cl.
CPC ..... *F25D 21/006* (2013.01); *F25D 21/004* (2013.01); *F25D 21/04* (2013.01);
(Continued)

(58) Field of Classification Search
CPC .. F25B 47/02; F25B 2347/00; F25B 2347/02; F25B 2500/14; F25B 2700/02;
(Continued)

(56) References Cited

U.S. PATENT DOCUMENTS 3,707,851 A 1/1973 McAshan, Jr.
3,736,765 A * 6/1973 O'Dell ..... F25D 29/005 62/127

(Continued)

FOREIGN PATENT DOCUMENTS

CN 103033013 A 4/2013
CN 103547872 A 1/2014

(Continued)

*Primary Examiner* — Len Tran
*Assistant Examiner* — Daniel C Comings

(57) ABSTRACT

A system and method for controlling a refrigeration system is disclosed. The system includes a cooled compartment, at least one heat source selectively activated to provide heat, at least one sensor, and a controller. The sensor detects a temperature and a relative humidity of ambient air that surrounds the cooled compartment. The controller is in communication with the at least one heat source and the at least one sensor. The controller includes logic for calculating a dew point temperature based on the temperature and the relative humidity. The controller also includes logic for selecting a region of operation based on at least one of the dew point temperature and the relative humidity, where the region of operation is representative of ambient conditions that surround the cooled compartment. The controller further includes logic for determining if the at least one heat source is activated based on the region of operation.

9 Claims, 3 Drawing Sheets

(51) Int. Cl.
*F25D 21/00* (2006.01)
*F25D 17/06* (2006.01)
*F25D 21/08* (2006.01)

(52) U.S. Cl.
CPC ..... *F25B 47/00* (2013.01); *F25B 2347/02* (2013.01); *F25B 2500/14* (2013.01); *F25B 2700/02* (2013.01); *F25B 2700/11* (2013.01); *F25B 2700/2106* (2013.01); *F25D 17/067* (2013.01); *F25D 21/00* (2013.01); *F25D 21/002* (2013.01); *F25D 21/008* (2013.01); *F25D 21/08* (2013.01); *F25D 2400/02* (2013.01); *F25D 2600/06* (2013.01); *F25D 2700/02* (2013.01); *F25D 2700/14* (2013.01)

(58) Field of Classification Search
CPC ..... F25B 2700/11; F25B 2700/2106; F25D 21/04; F25D 2700/14; F25D 21/002; F25D 21/004; F25D 21/006
See application file for complete search history.

(56) References Cited

U.S. PATENT DOCUMENTS 4,327,557 A 5/1982 Clarke et al.
4,432,211 A 2/1984 Oishi et al.
4,481,785 A 11/1984 Tershak
4,485,633 A 12/1984 King
4,487,030 A 12/1984 Carter et al.
4,553,400 A 11/1985 Branz
4,689,965 A 9/1987 Janke et al.
4,821,530 A 4/1989 Ledbetter
4,843,833 A * 7/1989 Polkinghorne ..... F25D 17/065 62/180
4,855,567 A 8/1989 Mueller
5,237,830 A 8/1993 Grant
5,271,236 A 12/1993 Sweetser
5,275,009 A 1/1994 Kobayashi et al.
5,442,933 A 8/1995 Unger
5,460,010 A 10/1995 Kobayashi et al.
5,473,911 A 12/1995 Unger
5,474,213 A 12/1995 Unger
5,483,804 A 1/1996 Ogawa et al.
5,524,445 A 6/1996 Morrow et al.
5,526,854 A 6/1996 Unger
5,564,286 A 10/1996 Suse
5,600,966 A 2/1997 Valence et al.
5,692,385 A 12/1997 Hollenbeck et al.
5,737,939 A 4/1998 Valence et al.
5,765,382 A 6/1998 Manning et al.
5,813,242 A 9/1998 Lawrence et al.
5,887,443 A 3/1999 Lee et al.
5,934,087 A 8/1999 Watanabe et al.
6,036,294 A 3/2000 Banicevic et al.
6,085,530 A 7/2000 Barito
6,131,400 A 10/2000 Seol et al.
6,226,995 B1 5/2001 Kalempa et al.
6,408,636 B1 6/2002 Backcs et al.
6,477,849 B2 11/2002 Butts et al.
6,868,678 B2 3/2005 Mei et al.
6,868,688 B2 3/2005 Narehood
6,912,860 B2 7/2005 Zima et al.
7,003,967 B2 2/2006 Rafalovich et al.
7,062,928 B2 6/2006 Karlsson et al.
7,082,380 B2 7/2006 Wiebe et al.
7,275,379 B2 * 10/2007 Zeng ..... B60H 1/0075 62/176.3
7,548,170 B1 6/2009 Griffel et al.
7,819,331 B2 10/2010 Arneson
8,978,467 B2 3/2015 Wagner et al.
9,086,233 B2 7/2015 Chun et al.
10,323,875 B2 * 6/2019 Sanders ..... F25D 21/006
2005/0268627 A1 12/2005 Vigh
2007/0006604 A1 * 1/2007 Behr ..... A47F 3/0443 62/246
2009/0090114 A1 4/2009 Choo
2012/0047919 A1 * 3/2012 Besore ..... F25D 21/04 62/80

FOREIGN PATENT DOCUMENTS

CN 204202274 U 3/2015
EP 2711654 3/2014
JP 2014 020715 2/2014

* cited by examiner

Heat Source Logic

| Region of Operation | Heater Source ON/OFF |
|---|---|
| Region 1 | OFF |
| Region 2 | Cycles with compressor 12 |
| Region 3 | ON |

FIG. 3

Defrost Operation Logic

| Region of Operation | # of Door Openings Since Last Defrost Cycle | Defrost Interval Extension |
|---|---|---|
| Region 1 | <=5 | extend by 1.87 |
| Region 2 | >5 | extend by 1.5 |
| Region 3 | >5 | reduce to 0.75 |

FIG. 4

Evaporation Fan Logic

| Region of Operation | Evaporation Fan 22 Delay |
|---|---|
| Region 1 | Delay is increased |
| Region 2 | Default |
| Region 3 | Delay is decreased |

FIG. 5

Heat Source Logic (15)

| Region of Operation | Heat Source ON/OFF |
|---|---|
| Region 1 | OFF |
| Region 2 | ON or Cycling |
| Region 3 | ON |

FIG. 6

SYSTEM AND METHOD OF CONTROLLING REFRIGERATOR AND FREEZER UNITS TO REDUCE CONSUMED ENERGY

TECHNICAL FIELD

This application relates generally to refrigerator and freezer units and, more specifically, to a control system for controlling at least one fan, heat sources, and/or defrost cycles of a refrigerator or freezer unit that reduces the amount of energy consumed.

BACKGROUND

Refrigerators are used in numerous settings, such as in a commercial setting or in a domestic setting. Typically, refrigerators are used to store and maintain food products by providing a cooled environment into which the products can be stored. Refrigeration systems typically include a refrigerated cabinet into which the food products are placed and a refrigeration assembly for cooling the air and products in the refrigerated cabinet. The refrigeration assembly often includes an evaporator assembly and a condenser assembly, each forming a portion of a refrigerant loop or circuit. A refrigerant is used to carry heat from air within the refrigerated cabinet to the ambient environment surrounding the refrigerated cabinet. The refrigerant absorbs heat in the evaporator assembly and then rejects the absorbed heat in the condenser assembly.

The refrigerator may also include a heat source located within the door as well as around the door frame in order to substantially prevent condensation from forming due to humid or moisture rich surrounding air. If the refrigerator includes a glass door, then a heat source may also be placed within the glass door to prevent condensation from obstructing viewing through the glass pane. Moreover, sometimes frost or condensate may accumulate on evaporator coils of the evaporator assembly, which decreases the efficiency of the refrigeration assembly. Defrosting cycles are typically utilized to remove the condensate from the evaporator coils. Once condensate has been removed from the evaporator, the condensate may be transferred to a condensate pan where it may accumulate. It is beneficial for the refrigeration unit to consume as little energy as possible, especially since it may be important for the refrigeration unit to meet federally mandated energy consumption limits or obtain specific types of energy certifications for maximum daily energy consumption. Thus, it would be desirable to provide a control system and method for reducing the energy consumed by the refrigeration unit.

SUMMARY

In one aspect, a system for controlling a refrigeration system is disclosed. The system includes a cooled compartment, at least one heat source that is selectively activated to provide heat, at least one sensor, and a controller. The sensor detects a temperature and a relative humidity of ambient air that surrounds the cooled compartment. The controller is in communication with the at least one heat source and the at least one sensor. The controller includes logic for calculating a dew point temperature based on the temperature and the relative humidity. The controller also includes logic for selecting a region of operation based on at least one of the dew point temperature and relative humidity of the ambient air, where the region of operation is representative of ambient conditions that surround the cooled compartment. The controller further includes logic for determining if the at least one heat source is activated based on the region of operation.

In another aspect, a method for controlling a refrigeration system is disclosed. The refrigeration system includes a cooled compartment and at least one heat source that is selectively activated to provide heat. The method comprises detecting a temperature and a relative humidity of ambient air that surrounds the cooled compartment by a sensor. The sensor is in communication with a controller. The method also includes calculating, by the controller, a dew point temperature based on the temperature and the relative humidity. The method further includes selecting, by the controller, a region of operation based on at least one of the dew point temperature and the relative humidity of the ambient air, where the region of operation is representative of ambient conditions that surround the cooled compartment. Finally, the method includes determining if the at least one heat source is activated by the controller based on the region of operation. The controller is in communication with the at least one heat source.

In another aspect, a refrigerated device includes a compartment and a refrigeration circuit for cooling the compartment. At least one sensor provides an output indicative of a temperature and relative humidity of ambient air that surrounds the cooled compartment. A controller is in communication with the at least one sensor and is configured to determine a dew point temperature based on the temperature and the relative humidity of the ambient air. The controller is also configured to identify an operating mode from among multiple operating modes based on at least one of the dew point temperature and/or the relative humidity of the ambient air. The controller is configured such that the operating mode at least in part defines at least one of (i) whether and/or how at least one heat source associated with an access door of the compartment is activated, (ii) a time between defrost cycles or (iii) how an evaporator fan is activated.

The details of one or more embodiments are set forth in the accompanying drawings and the description below. Other features, objects, and advantages will be apparent from the description and drawings, and from the claims.

BRIEF DESCRIPTION OF THE DRAWINGS

FIG. 3 is a diagram illustrating operation of the heat sources shown in FIG. 1;

FIG. 4 is a diagram illustrating operation of a defrost operation logic of the refrigeration system;

FIG. 5 is a diagram illustrating operation of an evaporator fan illustrated in FIG. 1: and FIG. 6 is a diagram illustrating operation of an electric condensate pan heater shown in FIG. 1.

DETAILED DESCRIPTION

Figure 1:
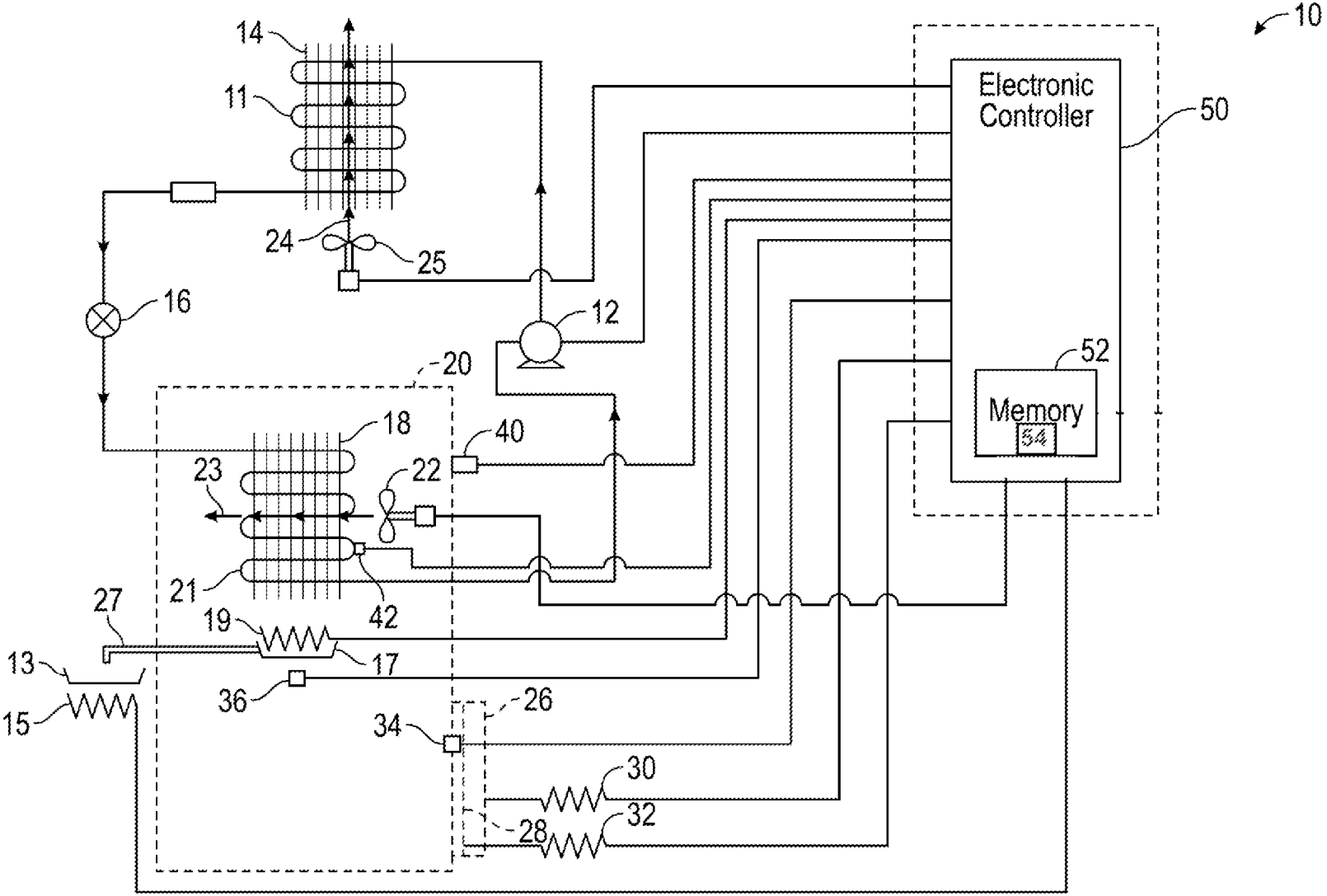
FIG. 1 is a schematic diagram of a refrigeration system and a controller for controlling the operation of the refrigeration system.

Referring to FIG. 1, a schematic diagram of a refrigeration system 10 is illustrated. The refrigeration system 10 includes a compressor 12, a condenser 14, an expansion device 16, and an evaporator 18. The condenser 12 may include a condenser coil 11 and an air circulating fan 25, and the evaporator 18 may include an evaporator coil 21 and an air circulating fan 22. Refrigerant fluid located within the refrigeration system may enter the evaporator 18. The refrigerant fluid is cooler than the area that surrounds the evaporator 18, which is shown as a cooled compartment 20. The cooled compartment 20 may be used to store items that require cooling or freezing such as, but not limited to, food products. The evaporator fan 22 may be located within the cooled compartment 20, and is used for directing cooled air 23 throughout the cooled compartment 20. When in the evaporator 18, the refrigerant fluid may absorb heat within the cooled compartment 20. The refrigerant fluid may then vaporize and turn into a vaporized refrigerant that is forced into the compressor 12. The compressor 12 compresses the vaporized refrigerant into a compressed vaporized refrigerant. The compressed vaporized refrigerant may then pass to the condenser 14. As seen in FIG. 1, intake air 24 may be passed through or over the condenser coils 11 of the condenser 14. A condenser fan 25 may be located within the condenser assembly 14, and is used to force air over condenser air to refrigerant heat exchanger to assist in the rejection of heat. When in the condenser 14, the compressed vaporized refrigerant may cool and is liquefied back into the refrigerant fluid.

The evaporator 18 may also include an evaporator drain pan 17 and a heat source 19. Condensate water collected in the evaporator drain pan 17 travels through a passageway 27 to a condensate pan 13 located outside a cooled compartment 20. The condensate pan 13 may include at least one heat source 15 that is illustrated as a heating element. The heat source 15 may be used for evaporating liquid condensate generated by the evaporator 18 that collects in the evaporator drain pan 17 and flows to the condensate pan 13. Additionally, the heat source 19 may be provided for defrosting the evaporator 18. The heat sources 15 and 19 may be, for example, heating elements or hot gas discharge circuits controlled via a one or more valves from the compressor 12.

Continuing to refer to FIG. 1, the cooled compartment 20 may include a door 26, which provides a user access to the cooled compartment 20. A switch 34 may be provided to generate a signal indicative of the door 26 being opened or closed, and a temperature sensor 36 may be placed within the cooled compartment and generates a signal indicative of a temperature of the air within the cooled compartment 20. A door frame (not illustrated) may surround the door 26. The door 26 and/or the door frame 28 may each include at least one heat source 30, 32 that are illustrated as heating elements. However, the heat sources 30, 32 may also be other types of heat sources instead such as, for example, infrared heat generated by a lighting source (not illustrated), or a hot gas discharge refrigerant circuit controlled via a valve from the compressor 12. If the door 26 includes a glass door pane (not illustrated), it is to be understood that a heat source may also be placed within the glass door pane as well. The heat source 30 may be selectively energized or activated in order to heat the door 26 to substantially prevent condensate from forming due to humidity or high levels of water vapor within ambient air. Similarly, the heat source 32 may be selectively energized to heat the door frame to substantially prevent condensate from forming as well.

It is to be appreciated that while FIG. 1 illustrates the heat sources 30, 32 placed within the door 26 and the door frame respectively, it is to be appreciated that the heat sources 30, 32 are merely exemplary in nature and the disclosure should not be limited to a door or a door frame heater. Indeed, any type of heat source that is selectively activated to prevent condensate from forming on a component of the refrigeration system 10 due to humidity or water vapor within ambient air may be used.

An ambient air sensor 40 may also be provided, and is positioned on the outside of the cooled compartment 20, within an ambient environment where the refrigeration system 10 is located. The ambient air sensor 40 may be used for generating a signal indicative of both a dry bulb temperature (DB temperature) as well as a relative humidity (RH) of ambient air that surrounds the cooled compartment 20. Although the DB temperature is discussed, it is to be understood that the ambient air sensor 40 may also be used to generate a signal indicative of either a wet bulb temperature (WB) or a dew point temperature (DP) as well. Moreover, although a single sensor is illustrated, it is to be appreciated that separate sensors may be used as well in order to generate signals indicative of the DP temperature (or, alternatively, the WB or the DP temperature instead) and relative humidity of the ambient air. A temperature sensor 42 may also be located on or near an evaporator coil (not illustrated) of the evaporator 18.

A controller 50 may be provided for controlling various operations of the refrigeration system 10. The controller 50 may refer to, or be part of, an application specific integrated circuit (ASIC), an electronic circuit, a combinational logic circuit, a field programmable gate array (FPGA), a processor (shared, dedicated, or group) comprising hardware or software that executes code, or a combination of some or all of the above, such as in a system-on-chip. The controller 50 is in communication with the compressor 12, the heat source 15, the evaporator fan 22, the condenser fan 25, the heat source 19, the heat source 30, the heat source 32, the switch 34, the temperature sensor 36, the relative humidity sensor 40, and the temperature sensor 42.

The controller 50 may control activation of the compressor 12, the evaporator fan 22, the condenser fan 25 and the heat sources 15, 30, 32 based on the signals received from the switch 34, the temperature sensor 36, the temperature sensor 42, and the relative humidity sensor 40, which is described in greater detail below. The controller 50 may also adjust a time interval between defrost cycles of the refrigeration system 10 as well based on the signals received from the switch 34 and the relative humidity sensor 40, and is explained in greater detail below. Specifically, a defrost operation may be performed by activating the heat source 19 to remove condensate that has accumulated on the evaporator coils 21 of the evaporator 18, or to evaporate liquid condensate that has accumulated in the condensate pan 13.

Figure 2:
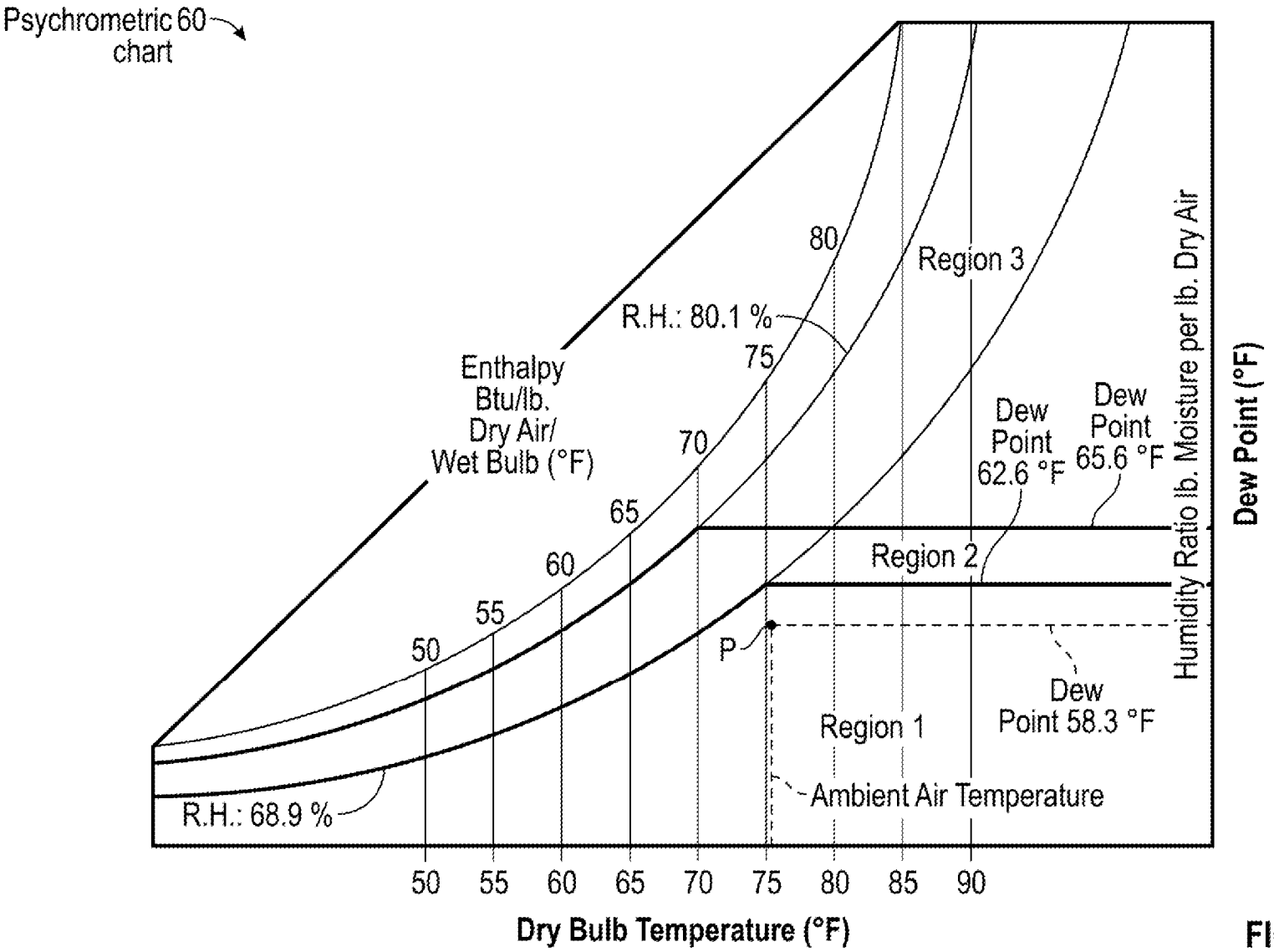
FIG. 2 is an illustration of an exemplary psychrometric chart stored in a memory of the controller shown in FIG. 1.

The controller 50 includes control logic or circuitry for determining a dew point of the ambient air that surrounds the cooled compartment 20 based on the signals received from the relative humidity sensor 40. Specifically, the controller 50 receives as input the signal indicative of the DB temperature as well as the relative humidity of ambient air from the relative humidity sensor 40. The controller 50 may then determine a respective dew point of the ambient environment based on a dew point calculator 54 that is saved within a memory 52 of the controller 50. The dew point calculator 54 may be alternatively implemented as a lookup table. Referring to both FIGS. 1 and 2, the dew point calculator 54 located in the program memory 52 may be representative of an exemplary psychrometric chart 60, which is shown in FIG. 2. As explained below, the controller 50 includes control logic for determining a dew point temperature (DP temperature) of the ambient air surrounding the cooled compartment 20 based on the DB temperature (or, alternatively, the WB temperature) and the relative humidity of the ambient air using the dew point calculator 54. The controller 50 may also determine if the ambient air measured by the relative humidity sensor 40 falls into a specific region of operation using the dew point calculator 54 as well, which is also described in greater detail below.

Turning now to FIG. 2, the psychrometric chart 60 is shown, where an x-axis of the psychrometric chart 60 is indicative of the DB temperature, and a y-axis of the psychrometric chart 60 is indicative of absolute humidity or a humidity ratio, as well as the DP temperature. In the embodiment as shown in FIG. 2, the psychrometric chart 60 includes measurements in English units. For example, temperature is measured in degrees Fahrenheit (° F.), enthalpy is measured in British thermal units (BTUs) per pound (BTU/lb.) and a humidity ratio is measured in pounds of moisture per pound of dry air. However, it is to be understood in another embodiment the psychrometric chart 60 may also be measured using the International System of Units (SI) as well.

The DP temperature of the ambient air that surrounds the cooled compartment 20 may be determined based on the DB temperature and the relative humidity of the ambient air measured by the relative humidity sensor 40 (FIG. 1). For example, as seen in FIG. 2, an exemplary measurement of ambient air collected from the relative humidity sensor 40 is plotted on the psychrometric chart 60. The measurement of ambient air includes a DB temperature of about 75.2° F. (24° C.)+/−1.8° F. and a relative humidity of about 55.6%, and is plotted on the psychrometric chart 60 as a point P. For example, in the embodiment shown in FIG. 2, the point P includes a DP temperature of 58.3° F. (14.6° C.). Once the point P is calculated and located upon the psychometric chart 60, a specific operating region may be determined. Those of ordinary skill in the art will readily appreciate that while the point P is described as being calculated based on the DB temperature and the relative humidity, the point P may also be determined based on the wet bulb temperature and the relative humidity as well.

Continuing to refer to FIG. 2, the psychrometric chart 60 is partitioned or sectioned into the specific regions of operation. In the embodiment as shown, there are three specific regions of operation, which are illustrated as Region 1, Region 2, and Region 3. The regions of operation are representative of the ambient conditions that surround the cooled compartment 20 (FIG. 1). Each region of operation is defined by a predetermined range of DP temperatures and a predetermined range of relative humidity.

Region 1 represents ambient conditions with relatively low levels of humidity and relatively cooler temperatures. The ambient conditions of Region 1 may be found in less humid regions of the world such as, for example, Las Vegas, Nev. In the non-limiting embodiment as shown in FIG. 1, Region 1 includes a predetermined range of DP temperatures of less than about 62.6° F. (17° C.) and a predetermined range of relative humidity less than about 68.9%. Region 2 represents moderate ambient conditions. For example, in the embodiment as shown Region 2 includes a predetermined range of DP temperatures ranging from about 62.6° F. to about 65.6° F. (18.6° C.) and a relative humidity ranging from about 68.9% to about 80.1%. Region 3 represents ambient conditions with relatively high levels of humidity and relatively warmer DP temperatures. The ambient conditions of Region 3 may be found in more humid regions of the world such as, for example, Key West, Fla. In the non-limiting embodiment as shown in FIG. 2, Region 3 includes a predetermined range of DP temperatures greater than about 65.6° F. and a relative humidity ranging from greater than about 80.1%.

It is to be appreciated that seasonal variances may occur, which cause the DP temperature and/or relative humidity to change regions. For example, during a season having cooler, drier conditions, the DP temperature and/or relative humidity may be located within Region 1 of the psychrometric chart 60. However, during another season, the same DP temperature and/or relative humidity may be located in Region 2 of the psychrometric chart 60. The DP temperature and/or relative humidity could also be located within Region 3 of the psychrometric chart 60 during a hotter, more humid season. It should be further appreciated that the DP temperature and/or relative humidity may move to another region of operation within a single day.

The point P may be located within Region 1, Region 2, or Region 3. For example, in the embodiment as shown, the point P falls with Region 1. As described in greater detail below, the controller 50 (FIG. 1) may activate the evaporator fan 22 and the heat sources 15, 30, 32 based on the location of the point P within the psychrometric chart 60 (i.e., based on whether the point P falls within Region 1, Region 2, or Region 3). It should be appreciated that while the point P may be used to determine operation within Region 1, Region 2, and Region 3, the specific regions of operation may be determined solely upon the relatively humidity instead, and is explained in detail below. Thus, the controller 50 (FIG. 1) may activate the evaporator fan 22 and the heat sources 15, 30, 32 based on the only the relative humidity.

It should also be appreciated that calculating an amount of total time that the heat sources 15, 30, 32 are on and the activation time of the heat sources 30, 32 relative to the activation of the compressor 12 may reduce or substantially eliminate condensation on the door 26 and/or door frame 28, and may reduce the amount of energy consumed by the refrigeration system 10. The controller 50 may also adjust the time interval between defrost cycles of the refrigeration system 10 based on the location of the point P, or relative humidity, within the psychrometric chart 60. Calculating an activation time and a total time on of the heat source 19 may reduce or substantially eliminate condensation on the evaporator 18 and/or the condensate pan 17, and may reduce the amount of energy consumed by the refrigeration system 10. Furthermore, calculating an activation time and a total time on of the heat source 15 of the condensate pan 13 may reduce the amount of energy consumed by the refrigeration system 10. Although FIG. 2 illustrates specific values for Region 1, Region 2, and Region 3, it is to be understood that these values are merely exemplary in nature, and that other values and ranges may be used as well. Indeed, those of ordinary skill in the art will readily appreciate that the values for Regions 1-3 may be adjusted based on the specific application of the refrigerator or freezer unit.

During some conditions, the controller 50 may be able to determine if the ambient conditions that surround the cooled compartment 20 (FIG. 1) fall within one of the specific regions of operation based on the relative humidity measured by the relative humidity sensor 40 (FIG. 1). Specifically, as seen in the psychrometric chart 60, if the relative humidity exceeds about 80.1%, then the refrigeration system 10 would operate within Region 3, no matter what the DB temperature may be. Thus, it should be appreciated that if the relative humidity reaches a threshold value (e.g., 80.1%), then the controller 50 may not require the DB temperature (or, alternatively, the WB temperature) to determine the specific region of operation.

Referring to FIGS. 1-3, the controller 50 may include control logic or circuitry for activating the heat sources 30, 32 based on whether the point P is located within Region 1, Region 2, or Region 3. Alternatively, the controller 50 may include control logic or circuitry for activating the heat sources 30, 32 if the relative humidity falls within Region 3. For example, in one approach, if the point P falls within Region 1, then the heat sources are not activated, thus no energy is supplied to the heat sources 30, 32. If the point P falls within Region 2, then the heat sources 30, 32 may be activated such that the heat sources 30, 32 cycles on and with the compressor 12. Furthermore, the activation of the heat sources 30, 32 relative to the activation of the compressor 12 may be controlled such that the heat sources 30, 32 are activated prior to activating the compressor 12 by a calculated time interval. Alternatively, the activation of the heat sources 30, 32 may be delayed relative to the activation of the compressor 12 by the calculated time interval. The cycling of the compressor is described in greater detail below. Finally, if the point P and/or relative humidity RH falls within Region 3, then the heat sources 30, 32 may be activated at all times (i.e., the heat sources 15, 30, 32 are always on). Furthermore, it is to be appreciated that each heat source 30, 32 may be independently controlled, and the calculated time intervals during operation in Region 2 may also be determined independently of one another.

The controller 50 includes control logic for cycling the compressor 12 on and off in order to maintain the air within the cooled compartment 20 at a constant set point temperature. Specifically, the controller 50 may first receive the signal generated by the temperature sensor 36 indicative of the temperature of the cooled compartment 20. The controller 50 may then activate or de-activate the compressor 12 in order to maintain the temperature of the cooled compartment 20 at the constant set point temperature.

Referring to FIGS. 1-2 and 4, the controller 50 may include control logic or circuitry for adjusting the time interval between defrost cycles of the refrigeration system 10 based on the signals received from the switch 34 indicative of the door 26 being opened, as well as if the point P falls within Region 1, Region 2, or Region 3 (or if the relative humidity falls within Region 3). For example, in one approach, if the point P falls within Region 1, and if the signal received from the switch 34 indicates the door 26 has been opened five times or less since the last defrost cycle, then the controller 50 may extend the interval between defrost cycles by a first predetermined factor. For example, in one embodiment, the first predetermined factor may be a factor of 1.87. Thus, if the current interval between defrost cycles is four hours, then the controller 50 would extend the interval between the defrost cycles to about 7.5 hours.

If the point P falls within Region 2, and if the signal received from the switch 34 indicates the door 26 has been opened more than five times since the last defrost cycle, then the controller 50 may extend the current interval between defrost cycles by a second predetermined factor. For example, in one embodiment, the second predetermined factor may be a factor of 1.5. Finally, if the point P and/or relative humidity falls within Region 3, and if the signal received from the switch 34 indicates the door 26 has been opened more than five times since the last defrost cycle, then the controller 50 may reduce the current interval between defrost cycles by a third predetermined factor. For example, in one embodiment, the first predetermined factor may be a factor of 0.75.

In one embodiment, the temperature sensor 42 located on or near the evaporator coil (not illustrated) of the evaporator 18 may be used to determine when to terminate the defrost operation, thereby deactivating the heat source 19. For example, the defrost operation may terminate when the temperature of the evaporator 18 as measured by the temperature sensor 42 reaches a predetermined temperature. For example, in one approach, the predetermined temperature is about 38° F. (3.3° C.). Once the heat source 19 is de-activated, the controller 50 may determine a time interval referred to as a drip time. During the drip time, liquid condensate may transfer from the evaporator 18 to the condensate pan 13. The length of the drip time may be adjusted (i.e., either shortened or lengthened) based on the specific regions of operation.

Referring to FIGS. 1-2 and 5, the evaporator fan 22 may be activated prior to or after the compressor 12 is activated in order to circulate cooled air throughout the cooled compartment 20. Furthermore, the evaporator fan 22 may be de-activated before or after the compressor 12. In one embodiment, the controller 50 includes control logic or circuitry for delaying the de-activation of the evaporator fan 22 once the compressor 12 is shut off. Specifically, the controller 50 may adjust delaying the de-activation of the evaporator fan 22 based on whether the point P falls within Region 1, Region 2, or Region 3 (or if the relative humidity falls within Region 3). For example, in one approach, if the point P falls within Region 1, then the evaporator fan 22 may run continually to prevent frost from forming on the evaporator 18, thus reducing the need for defrosting. If the point P falls within Region 2, then the delay to de-activate the evaporator fan 22 may stay the same. Finally, if the point P and/or relative humidity falls within Region 3, then the delay to de-activate the evaporator fan 22 may be decreased.

Referring to FIGS. 1-2 and 6, the heat source 15 may be activated to evaporate liquid condensate that flows to the condensate pan 13 based on whether the point P falls within Region 1, Region 2, or Region 3 (or if the relative humidity falls within Region 3). For example, in one approach, if the point P falls within Region 1, then the heat source 15 may be continuously off. If the point P falls within Region 2, then the heat source 15 may be continuously on, or, alternatively, the heat source 15 may cycle on and off. Finally, if the point P and/or relative humidity falls within Region 3, then the heat source 15 may be continuously on.

Thus, from the description above it is apparent that each of Region 1, Region 2 and Region 3 may be used to identify a distinct operating mode for a refrigerated device (e.g., a refrigerator unit or freezer unit), with the operating mode being based on at least one of the dew point temperature and/or the relative humidity of the ambient air. The controller 50 is configured such that the identified operating mode at least in part defines at least one of (i) whether and/or how at least one heat source associated with an access door of the compartment of the refrigerated device is activated, (ii) a time between defrost cycles or (iii) how an evaporator fan is activated. In some cases the operating mode may define all three.

Referring generally to the figures, the disclosed system provides a relatively simple, cost-effective approach for operating the refrigeration system 10 which may result in reduced amount of energy being consumed during specific operation conditions. Thus, a refrigerator or freezer unit including the disclosed controller 50 and refrigeration system 10 may now be able to meet specific meet federally mandated energy consumption limits or types of energy certifications for maximum daily energy consumption.

It is to be clearly understood that the above description is intended by way of illustration and example only, is not intended to be taken by way of limitation, and that other changes and modifications are possible.

What is claimed is:

1. A refrigerated device and associated control system, comprising:

a compartment including an access door engageable with a door frame when the door is closed;

a refrigeration circuit for cooling the compartment, the refrigeration circuit including an evaporator coil with an associated evaporator fan;

at least one sensor providing an output indicative of a temperature and relative humidity of ambient air that surrounds the compartment;

a controller in communication with the at least one sensor, wherein the controller is configured to:

determine a dew point temperature based on the temperature and the relative humidity of the ambient air; and based upon the dew point temperature and the relative humidity, select a control logic for controlling at least one of (i) activation of a heater of the door or the door frame, (ii) defrost operations of the evaporator coil or (iii) activation of the evaporator fan;

wherein the controller includes a memory storing a plurality of different regions of operation, wherein each region of operation is defined by a respective range of dew point temperatures and a respective range of relative humidities, and the controller is configured to match the dew point temperature and the relative humidity to one of the regions of operation to define an active region of operation for the refrigerated device, and the controller is configured to select the control logic based upon the active region of operation.

2. The refrigerated device of claim 1, wherein the controller is configured to select, based upon the dew point temperature and the relative humidity, each of (i) a control logic for controlling activation of the heater of the door or the door frame, (ii) a control logic for controlling defrost operations of the evaporator coil and (iii) a control logic for controlling activation of the evaporator fan.

3. The refrigerated device of claim 1 wherein the temperature detected by the at least one sensor is one of a dry bulb temperature or a wet bulb temperature.

4. The refrigerated device of claim 1 wherein the controller is configured to use the dew point temperature and the relative humidity to select one of a first region of operation or a second region of operation, wherein the first region of operation includes an associated first control logic and the second region of operation includes an associated second control logic that is different than the first control logic, and the controller is configured to select the control logic corresponding to the selected region of operation.

5. A method for controlling a refrigeration system, wherein the refrigeration system includes a cooled compartment, the method comprising:

determining a temperature and a relative humidity of ambient air that surrounds the cooled compartment based upon one or more sensors;

determining a dew point temperature of the ambient air; and based upon the dew point temperature and the relative humidity, selecting a control logic, from among multiple available and distinct control logics in a memory of a controller, wherein the control logic is to be used for controlling activation of a heater of a door or a door frame of the cooled compartment;

wherein the available and distinct control logics are different from each other in respect of whether and how the heater will be activated;

wherein the selecting of the control logic involves identifying a region of operation that is defined by a range of dew point temperatures and a range of relative humidities.

6. The method of claim 5, wherein the method further includes selecting, based upon the dew point temperature and the relative humidity, each of a control logic for controlling defrost operations of an evaporator coil and a control logic for controlling activation of an evaporator fan.

7. The method of claim 5, wherein the memory stores a plurality of different regions of operation, wherein each region of operation is defined by a respective range of dew point temperatures and a respective range of relative humidities, and the controller is configured to match the dew point temperature and the relative humidity to one of the regions of operation to define an active region of operation for the refrigeration system, and the controller is configured to select the control logic based upon the active region of operation.

8. A refrigerated device, comprising:

a cooled compartment;

at least one heat source selectively activatable to provide heat;

at least one sensor for detecting a temperature and a relative humidity of ambient air that surrounds the cooled compartment; and a controller in communication with the at least one heat source and the at least one sensor, the controller including a memory, and the controller including logic for:

determining a dew point temperature based on the temperature and the relative humidity of the ambient air;

matching the dew point temperature and the relative humidity indicated by the at least one sensor to one of at least two regions of operation, where each region of operation is defined by a respective range of dew point temperatures and a respective range of relative humidities; and selecting a control logic to be used for controlling the at least one heat source based on the active region of operation.

9. The refrigerated device of claim 8, wherein the at least one heat source is disposed within at least one of a door of the cooled compartment, along a door frame of the cooled compartment, a glass door pane of the cooled compartment, and a condensate pan for an evaporator.

* * * * *